US006319615B1

(12) United States Patent
Jansen

(10) Patent No.: US 6,319,615 B1
(45) Date of Patent: Nov. 20, 2001

(54) USE OF A THERMAL SPRAY METHOD FOR THE MANUFACTURE OF A HEAT INSULATING COAT

(75) Inventor: Franz Jansen, Winterthur (CH)

(73) Assignee: Sulzer Innotec AG, Winterthur (CH)

( * ) Notice: Subject to any disclaimer, the term of this patent is extended or adjusted under 35 U.S.C. 154(b) by 0 days.

(21) Appl. No.: 09/383,487

(22) Filed: Aug. 26, 1999

(30) Foreign Application Priority Data

Sep. 7, 1998 (EP) ..... 98810886

(51) Int. Cl.[7] ..... B32B 15/00; C23C 4/06; C23C 4/10

(52) U.S. Cl. ..... 428/469; 428/632; 428/633; 428/678; 428/680; 428/472; 428/937

(58) Field of Search ..... 428/615, 632, 428/633, 678, 680, 469, 472, 937; 427/446, 452, 453, 454, 455, 456; 416/241 R, 241 B

(56) References Cited

U.S. PATENT DOCUMENTS 4,487,841 * 12/1984 Bartuska et al. ..... 501/105
5,350,599 9/1994 Rigney .
5,384,200 1/1995 Giles .
5,418,015 * 5/1995 Jackson et al. ..... 427/452

FOREIGN PATENT DOCUMENTS 2356957 5/1975 (DE) .
0705911A1 4/1996 (EP) .
0712940A1 5/1996 (EP) .

* cited by examiner

*Primary Examiner*—Deborah Jones
*Assistant Examiner*—Jennifer McNeil
(74) *Attorney, Agent, or Firm*—Townsend and Townsend and Crew LLP

(57) ABSTRACT

The use of a thermal spray method relates to the production of a layer (20) for a heat insulating coat of a material (10) in powder form. This material consists at least to 80 mol % of zirconium silicate $ZrSiO_4$, in particular of the mineral zircon, and the majority of its powder particles (1) have diameters in the region between 10 and 100 $\mu$m. During the spraying on the particles are at least partially melted through in a gas flow (42) under reducing conditions and at a temperature greater than 20000° C. Method parameters, among others the dwell time of the particles in a heat imparting medium, in particular a plasma (41) or a flame, the temperature of the heat imparting medium and the momentum transferred to the particles, are chosen in such a manner that the layer (20) which is formed of the particles has a structure with lamellar elements (21). Suitable gases or gas mixtures, preferably hydrogen, are used as reducing means for the liberation of gases containing silicon, in particular silicon monoxide SiO; and/or a thermal liberation of gases containing silicon takes place as a result of a high temperature of the heat imparting medium.

12 Claims, 2 Drawing Sheets

USE OF A THERMAL SPRAY METHOD FOR THE MANUFACTURE OF A HEAT INSULATING COAT

BACKGROUND OF THE INVENTION

1. Field of the Invention

The invention relates to a thermal spray method for the manufacture of a heat insulating coat and to machine components with a heat insulating coat of this kind; it furthermore relates to uses of machine components of this kind.

2. Description of the Prior Art

A method for the manufacture of a plasma spray coat is known from DE-C 23 28 395 in which zirconium silicate $ZrSiO_4$ (or $ZrO_2.SiO_2$) is sprayed on. This material, which is very heat resistant ("fireproof") occurs naturally as a raw material, namely as sand from the mineral zircon. In the disclosed method a spray coat arises which is substantially composed of a mixture of tetragonal stable zirconium oxide $ZrO_2$ and amorphous silicon dioxide $SiO_2$. The tetragonal modification of the zirconium oxide is well suited for the development of protective coatings in contrast to the monoclinic modification, which is normally present at ambient temperature. These coatings form a protection against corrosion and wear at high temperatures.

Furthermore, it is known to use $ZrO_2$ for the manufacture of heat insulating coats, for example as a coating of guide blades in gas turbines. The object of the present invention is to use a thermal spray method in such a manner that a heat insulating coat of zircon which is more economical than $ZrO_2$, can be produced. In this it is to be achieved by suitable measures that the heat conductivity of a heat insulating coat of this kind is better up to 900° C. than that of the known coatings of $ZrO_2$ (heat conductivity index about 0.6–1.0 W/m.K at atmospheric pressure and room temperature).

SUMMARY OF THE INVENTION

The use in accordance with the invention of a thermal spray method relates to the manufacture of a layer for a heat insulating coat from a material in powder form. This material consists of zirconium silicate $ZrSiO_4$ at least to 80 mol %, in particular of the mineral zircon, and the majority of its powder particles have diameters in the region between 10 and 100 $\mu$m. During the spraying on the particles are at least partially melted through in a gas flow under reducing conditions and at a temperature greater than 2000° C. Method parameters, among others the dwell time of the particles in a heat imparting medium, in particular in a plasma or a flame, the temperature of the heat imparting medium and the momentum transferred to the particles are chosen in such a manner that the layer which is formed from the particles has a structure with laminar elements. Suitable gases or gas mixtures, preferably hydrogen, are used as reducing means for the liberation of gases containing silicon, in particular silicon monoxide SiO, and/or a thermal liberation of gases containing silicon takes place as a result of a higher temperature of the heat imparting medium.

Measurements at heat insulating coats which have been manufactured using the measures in accordance with the invention have yielded the following for the heat conductivity index at a pressure of 0.02 mbar: for a starting material $ZrSiO_4$-4.5 mol % $Nd_2O_3$ containing lanthanum dioxide, about 0.22 W/m.K at room temperature and about 0.31 W/m.K at 800° C. (at atmospheric pressure and room temperature the heat conductivity index is 0.6 W/m.K); for a starting material $ZrSiO_4$-4.5 mol % $Dy_2O_3$, about 0.18 W/m.K at room temperature and about 0.24 W/m.K at 800° C.

DETAILED DESCRIPTION OF THE PREFERRED EXEMPLARY EMBODIMENTS

Figure 1:
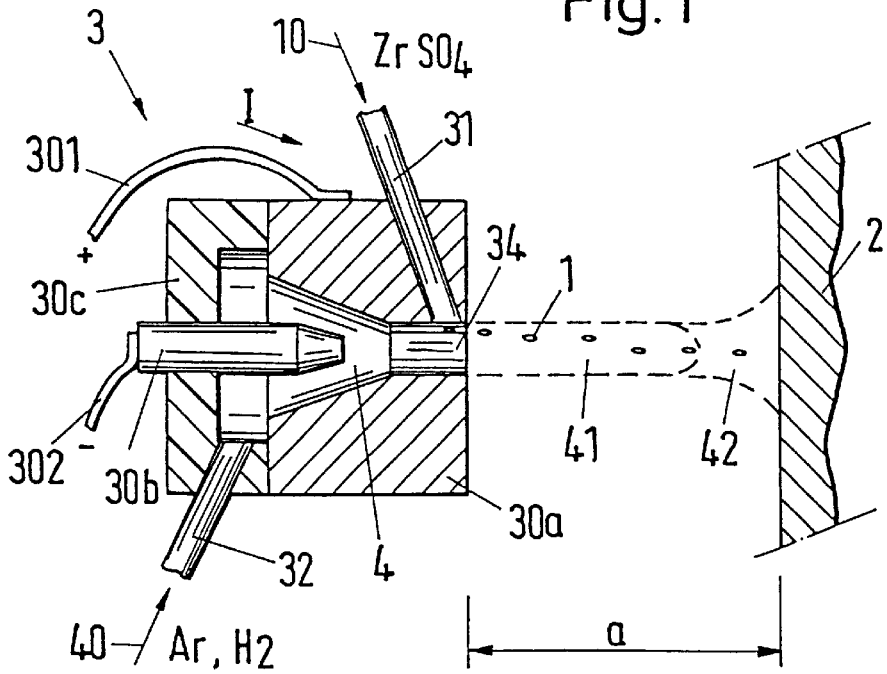
FIG. 1 is a schematic view of a device for carrying out a plasma spray method.

The device 3 illustrated in FIG. 1 for carrying out the spray method comprises a nozzle 34 formed of electrodes 30*a*, 30*b*, connections 301, 302 for an electrical direct current I, a supply line 32 for a plasma gas 40 of argon Ar as well as hydrogen $H_2$ and a supply line 31 for the material 10 to be sprayed, $ZrSiO_4$, which trickles in into the nozzle 34 in the form of powder particles 1. A cap 30*c* of a material which is an electrical non-conductor forms the rear closure of a cavity 4. In the latter a plasma 41 is produced, which emerges from the nozzle 34 as a hot gas flow 42. The gas flow 42 is directed onto a substrate 2, which is located at a distance a from the outlet opening of the nozzle 34. It pulls the supplied powder particles 1 along with it, accelerates them depending on the proportion of Ar to speeds of 120 to 250 m/s and heats them to temperatures above 2000° C. so that at least $SiO_2$ passes into a liquid phase. The temperature is influenced by the $H_2$ proportion: the higher the latter is, the higher is the temperature as well.

For the plasma gas the proportions of $H_2$ and Ar can vary within relatively broad limits; the volume relationship ($H_2$/Ar) should have a value between 0.01 and 0.5 under normal conditions. Other gases, for example He, can also be used as components of the plasma gas. For $H_2$ and Ar for example volume flows of about 5–20 and 20–60 normal litres per minute respectively are chosen. The current strength I lies in the range from 400–1000 A, preferably 500–700 A. The distance a of the nozzle 34 from the substrate 2 to be coated amounts to 50–150 mm.

Figure 2:
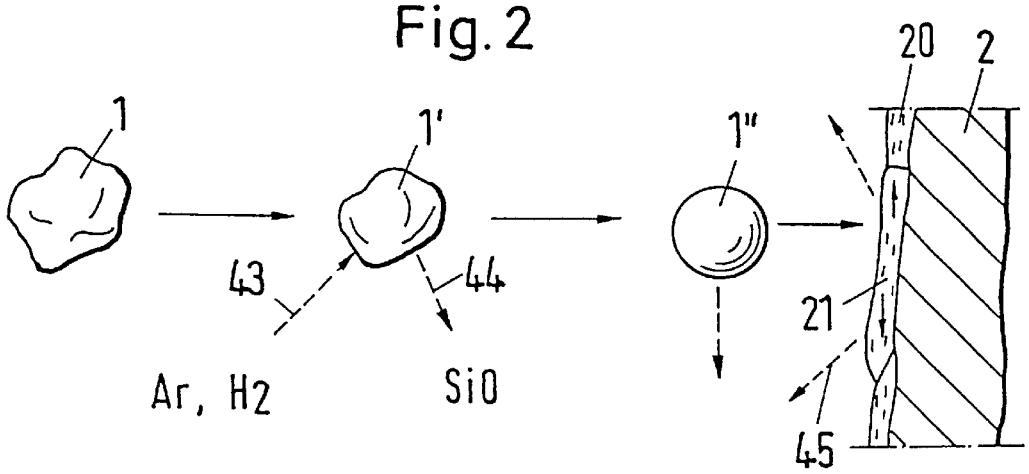
FIG. 2 is a schematic view of the flight of a powder particle when being sprayed onto a substrate.

In FIG. 2 the flight of a particle 1 in the hot gas flow 42, which contains Ar and $H_2$ (FIG. 1), is illustrated. After an initial solid stage, the particle 1 passes through a stage 1' in which it is liquefied at the surface. The completely melted through particle 1" is incident on the substrate 2, with it solidifying in a deformed condition to a laminar element 21. A large number of elements 21 of this kind forms a layer 20, which covers the substrate 2 or already produced layers. The hydrogen $H_2$ acts as a reducing medium-on the heated particle 1' (arrow 43) and has a liberation of gases containing silicon, in particular silicon monoxide SiO, as a consequence (arrow 44). In addition a thermal liberation of gases containing silicon also takes place as a result of the high temperature of the gas flow 42. Finally, after the incidence on the substrate 2, still further decomposition products containing silicon can be liberated (arrow 45). Investigations of coatings thus produced yielded that the atomic ratio between Zr and Si is greater than 1.1 (originally 1 in zircon). Components with an amorphous $SiO_2$ phase were not found; or these components were slight, less than around 6% (percent by weight). Proportions of $ZrSiO_4$ were less than 10%. The silicon Si is partially dissolved in $ZrO_2$. Values of less than 10% could be determined for the proportion of monoclinic $ZrO_2$. The $ZrO_2$ was present mainly stabilised in the cubic and/or tetragonal modification, which is substantially more favourable for the mechanical properties of the spray coating than the monoclinic. The stabilising of $ZrO_2$ results e.g. from the addition of lanthanide oxides (rare earth oxides), $Y_2O_3$ or $Sc_2O_3$.

For the stabilising of the $ZrO_2$ additional particles of $Y_2O_3$ or $Sc_2O_3$ and/or lanthanide oxides, in particular $Nd_2O_3$, $Yb_2O_3$ and/or $Dy_2O_3$, can also be added to the material to be applied. For the proportion of these lanthanide oxides or $Y_2O_3$ or $Sc_2O_3$ respectively, 3–10 mol % is advantageously chosen. These additives yield a reduction of the proportion of the $ZrO_2$ which has a monoclinic crystal structure. The thermo-mechanical durability of the spray coat is thereby improved.

Figure 3:
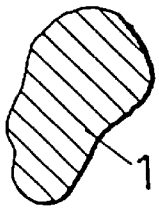
FIGS. 3, 4 are cross-sections through powder particles.
Figure 4:
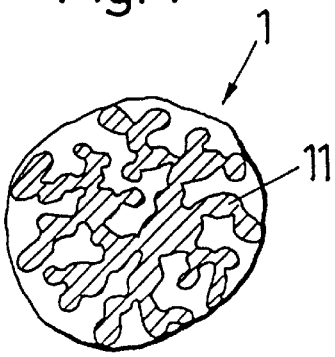

The material to be sprayed can consist of largely compact powder particles 1: see FIG. 3. The majority of their diameters should have values in the range between 10 and 100 $\mu$m. The powder particles 1 can also be formed to be porous, as shown in FIG. 4. These porous particles 1 yield spray coats which are particularly poor in Si. Particles 1 of this kind can be won from very finely ground powder which is spray dried in the form of a nozzled slurry. Ball-like agglomerates arise in this with a large number of particles 11, which are finally sintered together in a kiln. A pretreating of the spray powder in a thermal plasma brings about advantages such as improved flow behaviour and improved homogeneity when lanthanide oxides or $Y_2O_3$ or $Sc_2O_3$ respectively are added.

Figure 5:
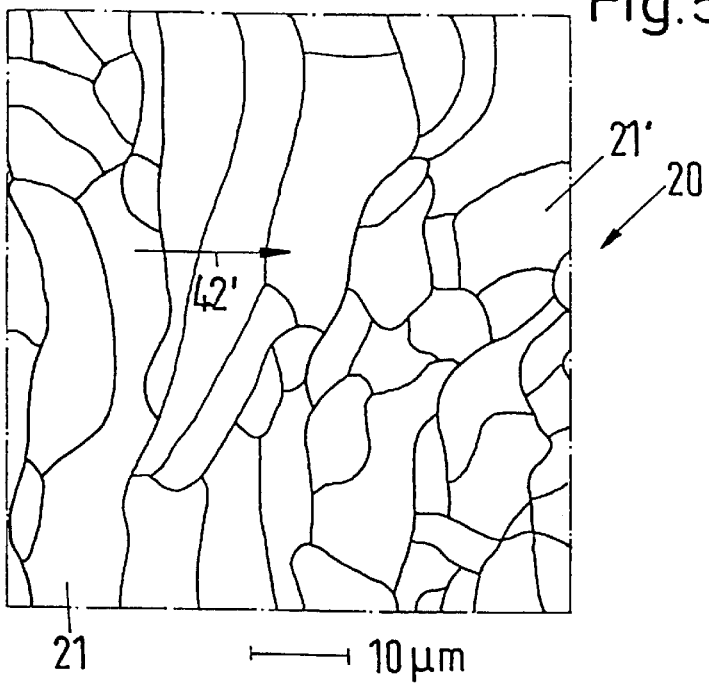
FIG. 5 illustrates morphological properties of a layer of a heat insulating coat produced in accordance with the invention.

FIG. 5 shows the structure of a coat produced of zircon with lamellar elements 21, with the drawing having been made on the basis of a test (electron microscopic image). In this draftsman's illustration only boundary lines are indicated; these were partly only weakly or not at all recognisable. Pores which were visible—partly in clusters—along the boundary lines have not been drawn. In addition to the lamellar elements 21 many non lamellar elements 21' can also be observed. The arrow 42' indicates the direction of the gas flow 42.

Figure 6:
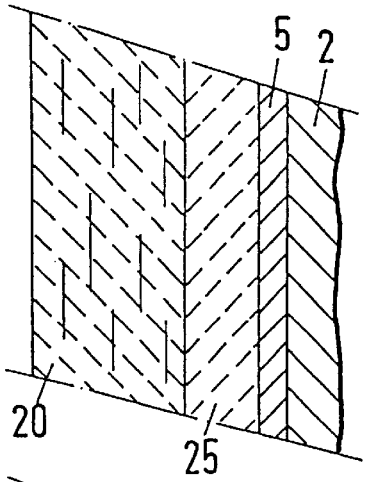
FIGS. 6–10 are cross-sections through diverse multiple layer heat insulating coats.

A heat insulating coat forms a part of a layer compound material—see FIG. 6—with the coat being bonded to the substrate 2 via an adhesive ground 5. The adhesive ground 5 consists of a metallic alloy, in particular of an alloy with the formula MCrAIX, with M=Ni, Co, NiCo, CoNi or Fe and X=Y, Hf, Pt, Pa, Re, Si or an arbitrary combination of the latter. The heat insulating coat is advantageously built up in multiple layers, with the layers alternatingly being produced using zirconium oxide—illustrated as layers 25—and zirconium silicate (zircon)—layers 20.

In example 6 the heat insulating coat consists of only two layers 25 and 20. Differently than illustrated in FIG. 6, a partly or fully stabilised $ZrO_2$ is advantageously provided for the outer layer 20, which should have a high thermo-mechanical stability. The inner layer 25 should have as low a heat conductivity index as possible. A combination of this kind allows a lesser coat thickness in comparison with conventional coatings, which are used for combustion chambers of gas turbines.

Figure 7:
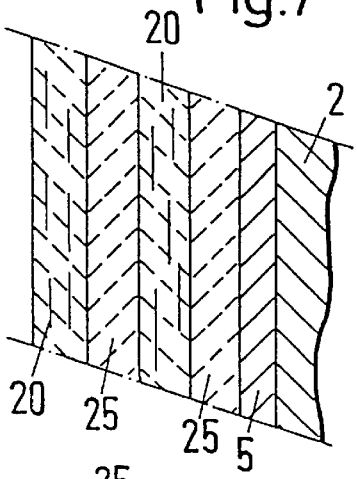
Figure 8:
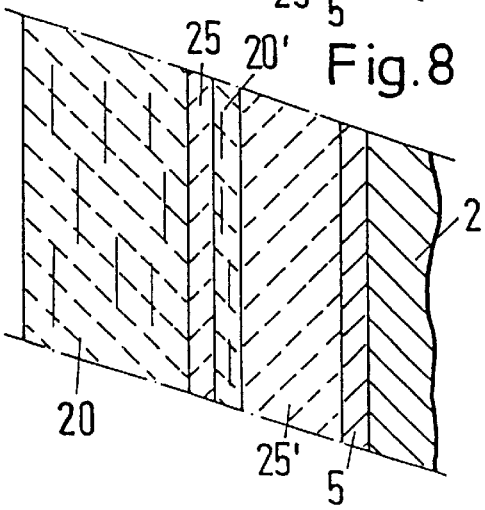

The example of FIG. 7 shows a large number of layers 20, 25, which are all approximately equally thick (about 100 $\mu$m). The layers 20, 25 can also have different thicknesses—see FIG. 8: a thick base coat 25', about 300 $\mu$m; then two thin coats 20', 25, in each case 20–40 $\mu$m; and finally another thick coat 20.

Figure 9:
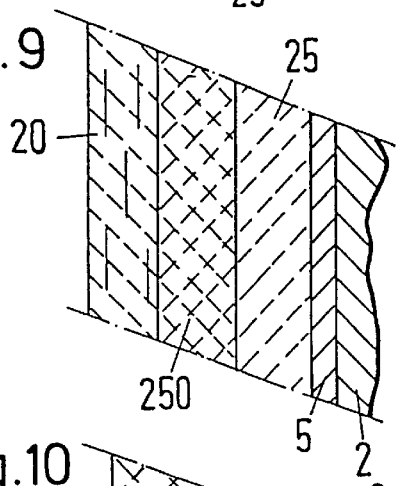

In the example of FIG. 9 a transition coat 250 is arranged between a base coat 25 and a cover coat 20. For this coat 250 a continually varying composition is provided which forms a transition from the composition of the base coat 25 to that of the cover coat 20.

Figure 10:
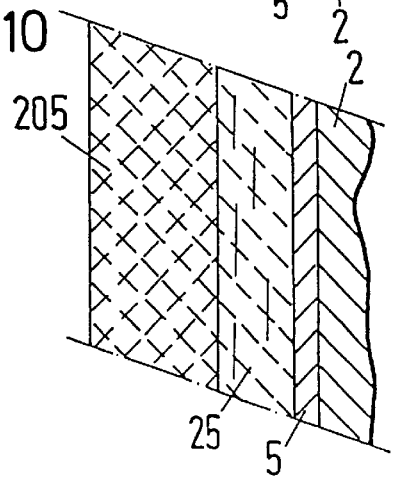

In the example of FIG. 10 the base coat 20 is produced using zircon. A ceramic cover coat 205 has, as does the transition coat 250, a continuously varying composition.

Instead of by means of plasma spraying, zircon heat insulating coats can also be manufactured by means of other thermal spray methods in which the heat imparting medium is formed by a flame.

The described heat insulating coats can advantageously be used in machine components which are used in a gas turbine or in a diesel engine. In these uses the heat insulating coats serve in each case as protection against a hot combustion gas.

What is claimed is:

1. A thermal spray method for the manufacture of a layer for a heat insulating coat of a material in powder form that consists of at least 80 mol % of zirconium silicate $ZrSiO_4$ wherein a majority of powder particles have diameters in the range between 10 and 100 $\mu$m, and wherein the particles are at least partially melted through a gas flow under reducing conditions and at a temperature greater than 2000° C., the method comprising choosing method parameters, including a dwell time of the particles in a heat imparting medium, a temperature of the heat imparting medium and momentum that is transferred to the particles, in such a manner that the layer that is formed of the particles has a structure with lamellar elements, and using suitable gases or gas mixtures as reducing means for the liberation of gases containing silicon.

2. A method in accordance with claim 1 wherein the material is a mineral zircon, the heat imparting medium is one of a plasma or a flame, and the gas being used as reducing means is hydrogen.

3. A method in accordance with claim 1 wherein the material consists of one of largely compact powder particles or of power particles that are porously formed.

4. A method in accordance with claim 3 wherein the material is used in a homogenized form that is subsequently treated with a thermal plasma.

5. A method in accordance with claim 1 wherein $Y_2O_3$, $Sc_2O_3$ and lanthanide oxides are additionally admixed to the material to be applied, and wherein the proportion of these lanthanide oxides or $Y_2O_3$ or $Sc_2O_3$, respectively, amounts to about 3–10 mol %.

6. A method in accordance with claim 5 wherein the lanthanide oxides are at least one of $Nd_2O_3$, $YB_2O_3$ and $Dy_2O_3$.

7. A method in accordance with claim 1 wherein the layer of the heat insulating coat is applied by means of plasma spraying with a device comprising a cavity formed of electrodes with a nozzle, connections for an electrical direct current, and supply lines for a plasma gas that forms the gas flow as well as for the material to be sprayed.

8. A method in accordance with claim 7 wherein the plasma gas is a mixture of $H_2$ and Ar, with a volume ratio under normal conditions of 0.01–0.05 $H_2$/Ar, wherein the current strength lies in a range from 400–1000 A, and wherein the distance of the nozzle from a substrate to be coated amounts to 50–150 mm.

9. A method in accordance with claim 8 wherein the current strength lies in a range from 500–700 A.

10. A machine component comprising one or more layered heat insulating coats of which layers are manufactured at least partly using a thermal spray method for the manufacture of a layer for a heat insulating coat of a material in powder form that consists of at least 80 mol % of zirconium silicate $ZrSiO_4$ wherein a majority of powder particles have diameters in the range between 10 and 100 $\mu$m, and wherein the particles are at least partially melted through a gas flow under reducing conditions and at a temperature greater than 2000° C., the method comprising choosing method parameters, including a dwell time of the particles in a heat imparting medium and a temperature of the heat imparting medium and momentum that are transferred to the particles, in such a manner that the layer that is formed of the particles has a structure with lamellar elements, using suitable gases or gas mixtures as reducing means for the liberation of gases containing silicon;

wherein the layers have an atomic ratio of Zr to Si that is greater than 1.1;

wherein constituents with amorphous $SiO_2$ phase are not present or are smaller than approximately 6% by weight, proportions of $ZrSiO_4$ are smaller than 10% by weight, proportions of monoclinic $ZrO_2$ are smaller than 10% by weight, $ZrO_2$ are present mainly stabilized in cubic and/or tetragonal modifications and Si are partly dissolved in the $ZrO_2$, and wherein the outer layer consists of at least partly stabilized $ZrO_2$;

wherein the heat insulating coat forms part of a layer compound material, with the heat insulating coat being bonded via an adhesive ground to a substrate and the adhesive ground consists of a metallic alloy; and wherein the metallic alloy is MCrAIX, with M=Ni, Co, NiCo, CoNi or Fe, and X=Y, Hf Pt, Pa, Re, Si or a combination thereof.

11. A machine component in accordance with claim 10 wherein the heat insulating coat is formed in two or more layers, with the layers being manufactured using zirconium silicate and zirconium oxide.

12. A machine component in accordance with claim 11 wherein the layers of zirconium silicate and zirconium oxide are disposed in an alternating arrangement.

* * * * *